United States Patent [19]

Cass

[11] Patent Number: 4,726,131

[45] Date of Patent: Feb. 23, 1988

[54] IDENTIFICATION TAGS

[75] Inventor: S. Thornton Cass, Grimsby, Canada

[73] Assignee: Dennison Manufacturing Company, Framingham, Mass.

[21] Appl. No.: 935,876

[22] Filed: Nov. 26, 1986

[30] Foreign Application Priority Data

Nov. 27, 1985 [CA] Canada ..... 496364
Feb. 10, 1986 [CA] Canada ..... 501502

[51] Int. Cl.[4] ..... A44C 3/00

[52] U.S. Cl. ..... 40/2 R; 283/80; 283/81

[58] Field of Search ..... 40/2 R, 20 R, 21 R, 40/6; 283/80, 81, 101; 206/459, 39; 128/155

[56] References Cited

U.S. PATENT DOCUMENTS 3,808,718 5/1974 Christiansen ..... 40/2 R
4,514,919 5/1985 Plutsky ..... 40/159
4,631,845 12/1986 Samuel et al. ..... 40/2 R

FOREIGN PATENT DOCUMENTS 75248 5/1976 Fed. Rep. of Germany ..... 283/80
1068891 5/1967 United Kingdom ..... 283/80
1384428 2/1975 United Kingdom ..... 40/2 R

*Primary Examiner*—John J. Wilson
*Assistant Examiner*—Michael Lynch
*Attorney, Agent, or Firm*—George E. Kersey

[57] ABSTRACT

A tag includes a primary panel capable of bearing identification indicia and a secondary panel capable of bearing identification indicia. The secondary panel is detachably secured to the primary panel along a line of separation, and coated, adjacent the line of separation, with a pressure sensitive adhesive. A backing strip having a release surface in contact with at least the adhesive coated area of said secondary panel is also provided.

17 Claims, 6 Drawing Figures

IDENTIFICATION TAGS

Figure 1:
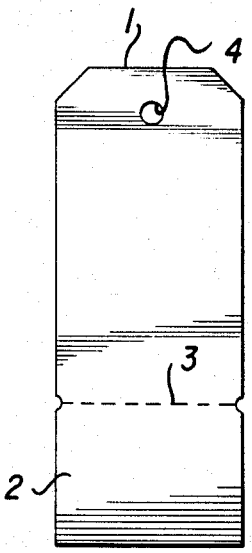

This invention relates to tags, especially those employed as luggage tags.

With the amount of air passenger traffic increasing annually, it is imperative that the passengers and their luggage be processed at the ticket counter as promptly as possible. At present, at least in North America, airline luggage is tagged generally in one of two fashions. In the first method, an airline clerk takes a numbered tag showing the destination of the passenger and separates the tag, along a weakened line of separation, into a major portion to be secured to the piece of luggage by an elastic loop and a minor portion to be stapled to the passenger's air ticket. The disadvantages of this method are clear. The clerk sometimes mislays the stapler or the latter is empty of staples; the time required to rectify these two situations is both onerous and frustrating to the waiting passenger. A further disadvantage is that it has been known for the staple to damage a passenger's shirt when he has placed his air ticket in the pocket of his shirt.

In another method, a numbered tag is also employed but staples are not required. In this method, the reverse face of the minor portion of the numbered tag is provided with a strip of pressure sensitive adhesive covered by a detachable backing sheet, adjacent the weakened line of separation. In operation, the airline clerk separates the tag into a major portion and a minor portion; attaches the major portion to the piece of luggage and then peels off the backing strip and sticks the minor portion to the passenger's ticket by means of the strip of pressure sensitive adhesive. It is true that the second method overcomes the disadvantages of the first. However, it too has disadvantages. An appreciable amount of time is required to peel off and then dispose of the backing strip. Moreover, the strip very often is just dropped on the floor, creating a very untidy working area and a potential safety hazard.

The object of the present invention is to provide a tag which overcomes all of the above disadvantages.

In one broad aspect, the present invention relates to a tag including: (a) a primary panel capable of bearing identification indicia; (b) a secondary panel capable of bearing identification indicia, detachably secured to said primary panel along a line of separation, and coated, adjacent said line of separation, with a pressure sensitive adhesive; and (c) a backing strip having a release surface in contact with at least the adhesive coated area of said secondary panel; said backing strip being secured to said primary panel adjacent said line of separation, whereby said secondary panel, upon detachment from said primary panel, presents its adhesive coated area for adhesion to any suitable surface.

In another broad aspect, the present invention relates to a tag having a primary panel and a secondary panel, each of said panels being capable of bearing identification indicia, said primary panel having one end coated with a release substance, and said secondary panel having one end coated with a pressure sensitive adhesive, the adhesive surface of said secondary panel being in face to face contact with the release surface of said primary panel, whereby said secondary panel can be peeled off said primary panel, and will present an adhesive surface for adhesion to any suitable surface.

In another broad aspect, the present invention relates to a tag including: a) a primary panel capable of bearing identification indicia; b) a secondary panel capable of bearing identification indicia detachably secured to said primary panel along a line of separation, said primary panel, adjacent the line of separation being provided with a release surface; c) a strip having a pressure sensitive adhesive surface in contact with at least the release surface of said primary panel; said strip being secured to said secondary panel adjacent said line of separation, whereby upon detachment of said secondary panel from said primary panel, the pressure sensitive adhesive surface on said strip is presented for adhesion to any suitable surface.

Figure 2A:
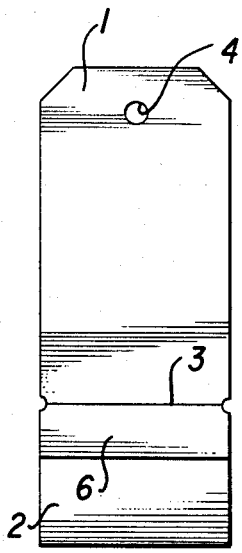
Figure 2B:
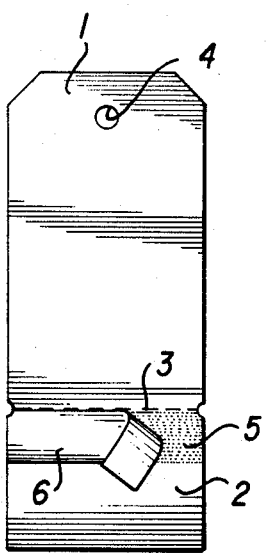
Figure 3A:
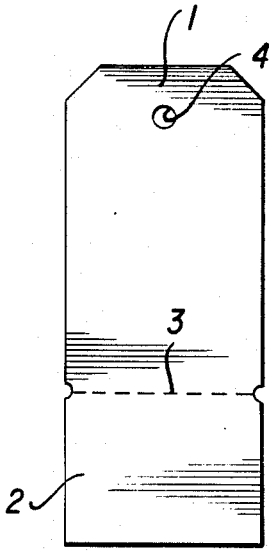
Figure 3B:
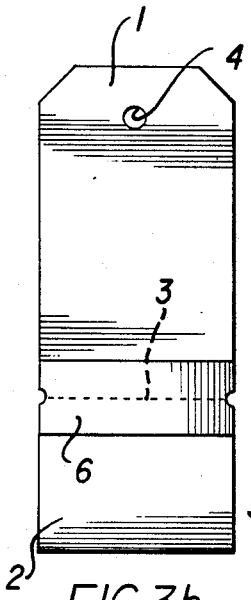

The invention is illustrated, by way of example, in the accompanying drawings in which:

FIGS. 1 and 2*a*- 2*b* are prior art tags;

FIG. 3*a* is a plan view of the tag forming the present invention;

FIG. 3*b* shows the reverse face of the tag of FIG. 3*a*, and

Figure 3C:
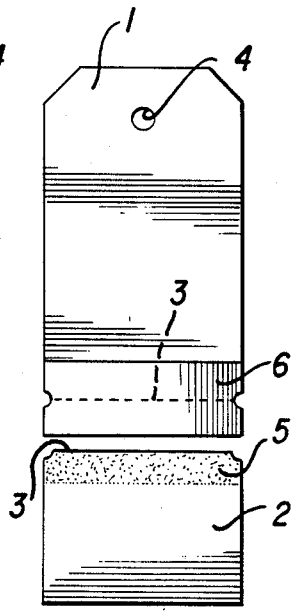

FIG. 3*c* shows the tag of the present invention separated into major and minor portions.

Referring to the drawings, and in particular to FIG. 1, this shows the first type of prior art tag described above with the tag divided into a major portion 1 and a minor portion 2 by means of a weakened line of separation 3. The major portion is provided with a hole 4 capable of locating an elastic loop (not shown) whereby the said main portion 1 can be attached to an article of luggage. Both portions 1 and 2 are capable of bearing identification indicia. As has been stated above, the clerk takes such a tag and separates it along the weakened line of separation 3 and secures the major portion 1 to the luggage and then staples the minor portion 2 to the passenger's air ticket.

FIGS. 2*a* and 2*b* show the tag employed in the second method described above and where the tag is again divided into major and minor portions 1 and 2 along a weakened line of separation 3 with the major portion 1 again provided with a hole 4 for the same purpose as that shown in FIG. 1. Again, one face (in this case, the upper) of the tag is capable of bearing identification indicia. The reverse face, shown in FIG. 2*a* and 2*b*, of the minor portion 2 is provided with a strip of pressure sensitive adhesive 5 located adjacent the weakened line 3 and covered with a backing strip 6. As has already been described above, the clerk separates the two portions 1 and 2 of the ticket and attaches the major portion 1 to the article of luggage. He then removes the backing strip 6 (generally dropping it on the floor!) from the minor portion 2 and sticks it to the passenger's air ticket.

A preferred form of the tag of the present invention is shown in FIGS. 3*a* to 3*c* where like reference numerals have been used. In this arrangement the reverse face of each of primary and secondary panels 1 and 2, adjacent the weakened line of separation 3 is provided with a predetermined area 5 of pressure sensitive adhesive, only that area 5 applied to the secondary panel 2 being shown, see FIG. 3*c*. A backing strip 6 covers both areas 5 of pressure sensitive adhesive.

Preferably, that portion of the backing sheet 6 which is in contact with the adhesive coated area of the primary panel 1 is wider than the portion in contact with the adhesive coated area of the secondary panel 2. This feature is illustrated in FIG. 3*c*, which shows a slightly wider sheet 6 than is shown in FIG. 3*b*, but is provided for the following reason. When the primary and secondary panels are separated for use (as explained below) it is desirable that the backing sheet remain attached to the primary panel. The backing sheet 6 has some, but not a great deal, of affinity for the pressure sensitive adhesive employed in the preferred form of the present invention. Accordingly, if a larger portion of the backing sheet is in contact with the adhesive coated area of the primary panel 1 than is in contact with the secondary panel 2, then when the panels are separated, the backing sheet will tend to remain adhesively secured to the primary panel 1. However, even if a smaller area of backing sheet contacts the primary panel 1, the tag is still operable, and it is merely a matter of grasping the backing sheet with the primary panel 1 when separating the primary 1 and secondary 2 panels, to ensure that the backing sheet 6 remains with the primary panel 1.

In an alternative embodiment, the backing sheet 6 may be secured to the primary panel 1 by a stronger adhesive (i.e. an adhesive with greater affinity for the slippery contact surface of the backing sheet) than that used on the secondary panel 2, adjacent the line of separation. Such an arrangement ensures that when the primary 1 and secondary 2 panels are pulled apart, the backing sheet 6 will remain affixed to the primary panel 1, thereby exposing the adhesive area on the secondary portion. This alternative, while effective, is not preferred, as it would require the use of two adhesives, thereby necessitating an extra step in the manufacturing process.

In a further alternative embodiment, (also not specifically illustrated) the backing strip 6 is provided with a slippery release surface along only one side of its length - the side which will be in contact with the adhesive area of the secondary panel 2. The other side of the tape will not be provided with a slippery release surface, but will be a plain paper (or other common tape substrate) surface, which will adhere tenaceously to the adhesive coated area of the primary panel. This alternative, while effective, is not preferred, because it requires the production of a non-standard release tape.

In a still further alternative embodiment (also not specifically illustrated) that area of the primary panel 1 adjacent the line of separation 3 which, in the other embodiments described above is coated with adhesive, is itself coated with slippery release substance. In this embodiment, the backing sheet 6 is eliminated, and the secondary panel 2, adjacent its line 3 is coated with pressure sensitive adhesive. The adhesive area 5 of secondary panel 2 is then placed in direct face to face contact with the release area of the primary panel. In this embodiment, it will be understood that no backing sheet 6 is required, and in the above description, reference to the line of separation 3 of the panels 1 and 2 is for convenience only, the panels being entirely discrete, and connected by adhesive only.

In another alternative embodiment, the backing sheet 6 is not a release type of tape but is an adhesive tape. The area adjacent line of separation 3 on the minor portion 2 of the tag is not provided with a release surface. Accordingly, when applied thereto, the backing sheet 6 (adhesive tape) will adhere permanently to the minor portion 2 of the tag. However, the major portion 1 of the tag, adjacent the line of separation 3 is provided with a release surface, such as a wax coating. Therefore, when the minor portion 2 is grasped and pulled away from the major portion 1 of the tag, it will become separated therefrom, and the adhesive-coated surface of the backing sheet 6 will be presented, co-extensive with the upper surface of the tag. It will be understood, then, that when the minor portion of the tag is subsequently adhered to a ticket, only the reverse surface will be visible, unless the minor portion 2 is folded back. Accordingly, in this embodiment, it is expedient to provide a serial number on the major portion 1 of the tag, and a matching serial number on the reverse surface of the minor portion 2. Currently, serial numbers are printed on the upper surfaces of both tags.

A modification of the last-mentioned embodiment, if it is desired to print serial identification numbers on the upper surfaces of both the major and the minor portions of the tag, is as follows. The adhesive tape (which is in permanent contact with the minor portion, and releasable contact with the major portion) may be situated on the upper surface of the tag, bridging the major and minor portions, with its adhesive surface facing downwardly. Then, when the minor portion is separated from the major portion, the minor portion may be secured to an airline ticket, with the serial number printed on the upper surface of the minor portion, clearly visible.

To use the above described invention, the clerk grasps both panels 1 and 2 and pulls the second panel 2 apart from the primary panel 1 along the line of separation 3. The force of this procedure is sufficient to break the bond between the area 5 of adhesive on the secondary panel 2 and the backing strip 6 which, as explained above, remains adhering to the primary panel 1 as is shown in FIG. 3*c* (note, however, the exceptions described). The clerk then attaches the primary panel 1 to the article of luggage in the normal way (with the backing strip 6 still adhering to said panel 1) and then presses the secondary panel 2 against the passengers air ticket so that it adheres thereto thereby obviating the need for staples, overcoming the garbage problem, and materially speeding-up the processing of both passenger and his luggage.

I claim:

1. A tag including:

(a) a primary panel capable of bearing identification indicia;

(b) a secondary panel capable of bearing identification indicia, detachably secured to said primary panel along a weakened line of separation, and coated, adjacent said line of separation, with a pressure sensitive adhesive; and (c) a backing strip having a release surface in contact with at least the adhesive coated area of said secondary panel;

said backing strip being secured to said primary panel adjacent said line of separation, whereby said secondary panel, upon detachment from said primary panel, presents its adhesive coated area for adhesion to any suitable surface.

2. A tag as described in claim 1 wherein said primary panel, adjacent the said line of separation, is coated with a pressure sensitive adhesive, and said backing strip is secured to said primary panel by contact with the adhesive coated surface of said primary panel.

3. A tag as described in claim 2 wherein the surface of said strip in contact with the adhesive coated area of said primary panel is not provided with a release surface, said strip thereby tenaceously adhering to said primary panel.

4. A tag as described in claim 3 wherein said tag is an airline baggage tag.

5. A tag as described in claim 2 wherein the surface of said strip in contact with the adhesive coated area of said primary panel is provided with a release surface.

6. A tag as described in claim 5 wherein the area of said strip in contact with the adhesive coated area of said primary panel is larger than the area of said strip in contact with the adhesive coated area of said secondary panel, said strip thereby tending to remain attached to said primary panel upon detachment of said secondary panel from said primary panel.

7. A tag as described in claim 6 wherein said tag is an airline baggage tag.

8. A tag as described in claim 5 wherein said tag is an airline baggage tag.

9. A tag as described in claim 2 wherein said tag is an airline baggage tag.

10. A tag as described in claim 1 wherein said strip is connected to said primary panel by means of a non-pressure sensitive adhesive.

11. A tag as described in claim 1 wherein the release surface of said strip is in contact with an adhesive coated surface of said primary panel, the adhesive coating of said primary panel being an adhesive with affinity for said release surface, said strip thereby being bonded securely to said primary panel.

12. A tag as described in claim 1 wherein said tag is an airline baggage tag.

13. A tag including:

(a) a primary panel capable of bearing identification indicia;

(b) a secondary panel capable of bearing identification indicia detachably secured to said primary panel along a weakened line of separation, said primary panel, adjacent the line of separation being provided with a release surface;

(c) a strip having a pressure sensitive adhesive surface in contact with at least the release surface of said primary panel;

said strip being secured to said secondary panel adjacent said line of separation, whereby upon detachment of said secondary panel from said primary panel, the pressure sensitive adhesive surface on said strip is presented for adhesion to any suitable surface.

14. A tag as described in claim 13, wherein the adhesive surface of said strip is continuous on one entire surface of said strip, and said strip is secured to said secondary panel by contact of said adhesive surface with the secondary panel, adjacent the line of separation.

15. A tag as described in claim 14, wherein the upper surface of said primary panel is indicia bearing, the lower surface of said secondary panel is indicia bearing, and said strip contacts both said panels on the lower surfaces thereof.

16. A tag as described in claim 14, wherein the upper surface of said primary panel is indicia bearing, the upper surface of said secondary panel is indicia bearing, and said strip contacts both said panels on the upper surfaces thereof.

17. A tag as described in claim 14, wherein the upper surface of said primary panel is indicia bearing, the upper surface of said secondary panel is indicia bearing, and said strip contacts both said panels on the lower surfaces thereof.

* * * * *